US008444367B2

(12) United States Patent
Lougheed

(10) Patent No.: US 8,444,367 B2
(45) Date of Patent: May 21, 2013

(54) LOCKING DEVICE FOR SECURING A BACKHOE ATTACHMENT TO A CARRIER LIFT ARM

(75) Inventor: Christopher Lougheed, Litchfield, MN (US)

(73) Assignee: Clark Equipment Company, West Fargo, ND (US)

( * ) Notice: Subject to any disclaimer, the term of this patent is extended or adjusted under 35 U.S.C. 154(b) by 1035 days.

(21) Appl. No.: 12/175,800

(22) Filed: Jul. 18, 2008

(65) Prior Publication Data

US 2010/0014952 A1 Jan. 21, 2010

(51) Int. Cl.
*B66F 9/00* (2006.01)

(52) U.S. Cl.
USPC ..... 414/686; 37/468

(58) Field of Classification Search
USPC ..... 414/607, 686, 694, 723, 912; 37/468
See application file for complete search history.

(56) References Cited

U.S. PATENT DOCUMENTS

| | | | | |
|---|---|---|---|---|
| 2,660,327 | A * | 11/1953 | Blatz | 414/607 |
| 2,725,999 | A * | 12/1955 | Wise | 414/607 |
| 3,531,140 | A | 9/1970 | Vita et al. | |
| 3,732,996 | A | 5/1973 | Bauer | |
| 3,892,322 | A | 7/1975 | Drennhaus | 214/131 |
| 3,935,953 | A | 2/1976 | Stedman | |
| 3,984,016 | A | 10/1976 | Kuhn | 214/131 |
| 4,117,944 | A | 10/1978 | Beckstrom et al. | 214/131 |
| 4,150,504 | A | 4/1979 | Asche | |
| 4,279,566 | A | 7/1981 | Sagaser et al. | 414/686 |
| 4,411,584 | A | 10/1983 | Shumaker | 414/694 |
| 4,545,720 | A | 10/1985 | Cochran et al. | |
| 4,715,771 | A | 12/1987 | Hanson | 414/688 |

(Continued)

FOREIGN PATENT DOCUMENTS

| | | |
|---|---|---|
| DE | 195 25 387 | 1/1997 |
| EP | 1 365 073 | 11/2003 |
| FR | 2 747 137 | 10/1997 |
| JP | 52164302 | 12/1977 |

OTHER PUBLICATIONS

Bobcat Operation and Maintenance Manual 607 & 709 Backhoe, pp. 1 and 25-37.

(Continued)

*Primary Examiner* — Joshua Rudawitz
(74) *Attorney, Agent, or Firm* — John D. Veldhuis-Kroeze; Westman, Champlin & Kelly, P.A.

(57) ABSTRACT

A mounting frame for attaching a backhoe or other implement to a lift arm of a vehicle, such as a compact loader, includes an upright arm on the mounting frame that is positioned ahead of and adjacent to a forward portion of a lift arm of the loader. The upright arm carries a pivoting locking handle at a first pivot and a locking link is pivotally supported on the locking handle on a first pivot pin. The locking link has a second pivot pin that can be moved to be supported in an existing pin sleeve or bushing on the lift arm. The pivot pins on the locking link are positioned so that when the locking handle is moved to a locked position, the line between the axes of the pivot pins on the locking link goes over center with respect to the pivot axis of the first pivot locking handle, and a hook end of the link latches onto a locking projection on the upright arm. The mounting frame is held in a fixed position relative to the lift arm.

20 Claims, 6 Drawing Sheets

U.S. PATENT DOCUMENTS

| | | | | |
|---|---|---|---|---|
| 4,735,547 | A | 4/1988 | Wagner et al. | 414/686 |
| 4,897,010 | A * | 1/1990 | Golley | 414/24.6 |
| 4,921,392 | A | 5/1990 | Wagner | |
| 5,004,398 | A | 4/1991 | Wagner et al. | 414/723 |
| 5,199,344 | A | 4/1993 | Wagner et al. | |
| 5,421,417 | A | 6/1995 | Kraft et al. | |
| 5,570,991 | A | 11/1996 | Swenson et al. | |
| 5,590,483 | A * | 1/1997 | Kim | 37/468 |
| 5,634,736 | A * | 6/1997 | Brown et al. | 403/322.4 |
| 5,685,689 | A * | 11/1997 | Schneider et al. | 414/723 |
| 5,692,855 | A * | 12/1997 | Burton | 403/325 |
| 6,076,855 | A | 6/2000 | Webb | |
| 6,238,130 | B1 * | 5/2001 | Youngers | 403/322.4 |
| 6,422,805 | B1 * | 7/2002 | Miller | 414/723 |
| 6,443,490 | B2 | 9/2002 | Webb | |
| 6,533,526 | B2 * | 3/2003 | Lindgren et al. | 414/667 |
| 6,763,864 | B2 | 7/2004 | Setlack et al. | 144/195.1 |
| 6,994,511 | B2 * | 2/2006 | Westendorf et al. | 414/686 |
| 7,290,977 | B2 * | 11/2007 | Albright et al. | 414/723 |
| 7,674,085 | B2 * | 3/2010 | Bystrom | 414/723 |
| 7,699,577 | B2 * | 4/2010 | Lougheed et al. | 414/723 |
| 7,797,862 | B2 * | 9/2010 | Daraie et al. | 37/468 |
| 7,824,145 | B2 * | 11/2010 | Kisse | 414/723 |
| 2006/0053761 | A1 * | 3/2006 | Lougheed et al. | 56/15.8 |
| 2006/0104785 | A1 | 5/2006 | Vachon | 414/686 |
| 2006/0210385 | A1 | 9/2006 | Cook | 414/725 |

OTHER PUBLICATIONS

Bobcat Operation and Maintenance Manual M06 Backhoe, pp. 1 and 24-42.

Bobcat Operation and Maintenance Manual 811 Backhoe, pp. 1 and 32-42.

Bobcat Operation and Maintenance Manual 406 & 506 Backhoe, pp. 1 and 21-34.

Bobcat Backhoe Attachment Brochures—6 pages.

Description of MT50, MT52 and MT55 Bobcat Mini Loader Backhoe Mounting Prior Art and pp. 21, 28, 41,42 and 58 of M06 Backhoe operation and Maintenance Manual, and Drawing 7101555.

International Search Report and Written Opinion, dated Oct. 1, 2009.

Communication dated Oct. 25, 2011 in European application No. 09790371.0, filed Jul. 14, 2009, 5 pages.

Communication dated Jun. 4, 2012 in European application No. 09790371.0, filed Jul. 14, 2009, 6 pages.

Communication dated Feb. 13, 2012 in Chinese application No. 200980128051.X, filed Jan. 14, 2009, with English translation attached, 8 pages.

* cited by examiner 18
24
42
10
50
24
28
53
54
22
40
34
32
46
14

24
53
52
38
59
58
66
40
26
54
50
44

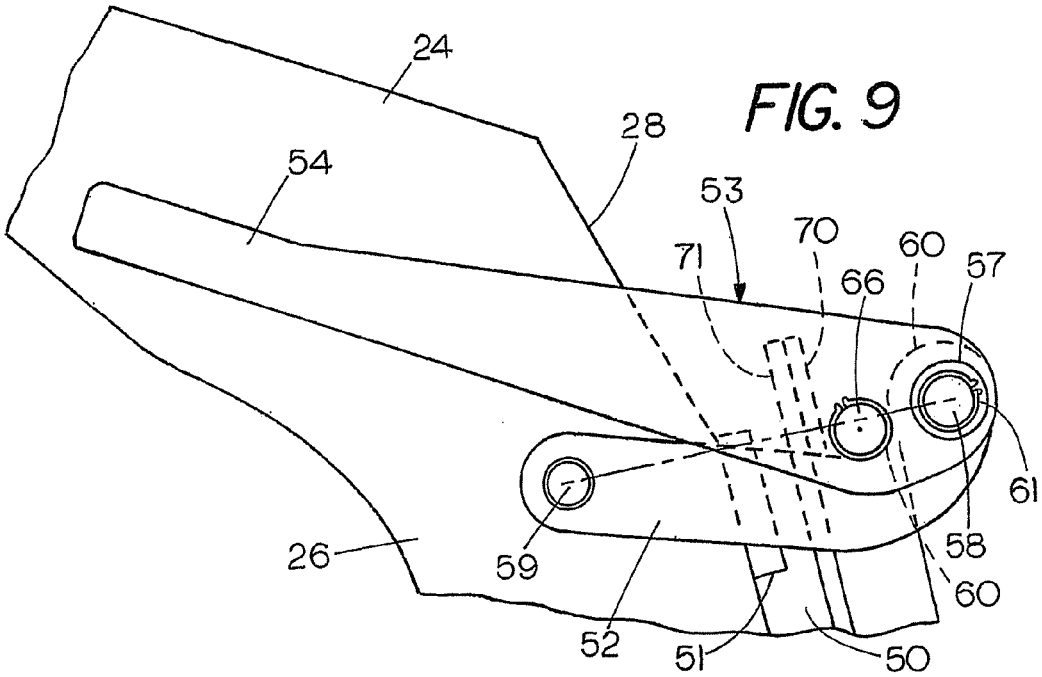
FIG. 9
FIG. 10
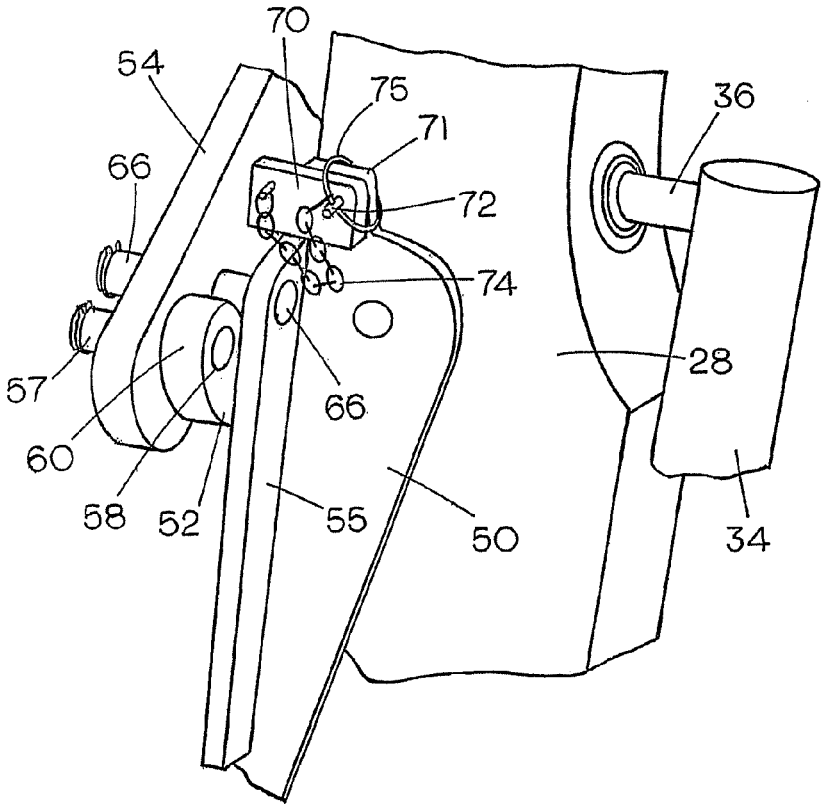

LOCKING DEVICE FOR SECURING A BACKHOE ATTACHMENT TO A CARRIER LIFT ARM

BACKGROUND OF THE DISCLOSURE

The present disclosure relates to a locking assembly for securing a backhoe or other implement attachment that is mounted on the front of lift arms of an attachment carrier, such as a compact loader.

Mounting devices for attaching implements, such as backhoes to carrier vehicles are in wide use. In many instances, the implement that is attached is supported on a tilting attachment plate on a loader or carrier through a suitable latching mechanism, and in many cases the attachment mounting frame has cross rails on which the implement is mounted so the implement can move from side to side relative to the longitudinal axis of the carrier.

It is necessary to ensure that the implement mounting frame is securely supported on the carrier. U.S. Pat. No. 4,279,566 shows a backhoe mounting device, as does U.S. Pat. No. 5,004,398. In the case of the '398 patent, the attachment is secured with an over center latch, but the latch secures the backhoe mounting frame to the main frame of the carrier so that the lift arms are not operable to lift the backhoe or other implement.

SUMMARY OF THE DISCLOSURE

A locking assembly for locking or securing a mounting frame of an implement carried on lift arms of a compact carrier vehicle, such as a skid steer loader, a four wheel loader, or a track driven loader onto the lift arms is disclosed. The mounting frame for the implement, which is disclosed as a backhoe, is attached to a standard tilting attachment plate that is conventionally used for mounting implements onto loader lift arms. The implement mounting frame includes an upright portion, as shown an upright support arm or member on at least one side that pivotally mounts a locking handle. A locking link is pivotally mounted on the locking handle and also has a fixed second pivot pin which engages an open end of an existing bore in a bushing or sleeve in the lift arm used in part for mounting a pin for a tilt cylinder for the tilting attachment plate. The locking link preferably is configured to hook over a pin on the upright support to form a latch. The pivots of locking handle and locking link are positioned so when the locking handle is moved to a locked position, the locking link hooks over the pin on the upright support arm and the line between pivot axes of the locking link pivot pins goes over center with respect to the pivot between the locking handle and the upright arm on the mounting frame. This will prevent the mounting frame from moving away from the respective lift arm. The upright arm and thus the implement mounting frame and implement are held against the carrier lift arms and the implement can be raised and lowered with the lift arms.

An aspect of the present disclosure is that the locking link is pivoted on a locking handle that is mounted on an elongated, laterally extending pivot pin fixed to the mounting frame. The locking handle and the attached locking link can be slid outwardly along the elongated pivot pin sufficiently so that the fixed pin on the locking link clears a side of the lift arm. The locking link can be moved to align with existing bushing or sleeve that is for the mounting pin for a tilt cylinder, and the fixed pin on the locking link then can be slid into an open or unused length of the bore of the bushing or sleeve for the tilt cylinder pin. The locking handle can then be pivoted to a locked position and the locking link hook will engage a pin on the upright arm, as shown a portion of the elongated pivot pin for locking lever, and the upright arm of the mounting frame is pulled tightly against the lift arm, as the line between the locking link pivots goes over center with respect to the pivot of the locking handle. The locking handle can be secured in locking position with a separate pin.

The implement mounting frame can thus be attached and removed from the lift arms of the carrier, such as a loader, easily. The backhoe or other implement is secured against the lift arms and the operator can raise and lower the implement as desired.

BRIEF DESCRIPTION OF THE DRAWINGS

FIG. 9 is a side view of the locking handle and locking link in a mounting frame locked position; and FIG. 10 is a fragmentary front perspective view showing a pin in place to ensure the locking assembly remains locked.

DETAILED DESCRIPTION OF ILLUSTRATIVE EMBODIMENTS

Figure 1:
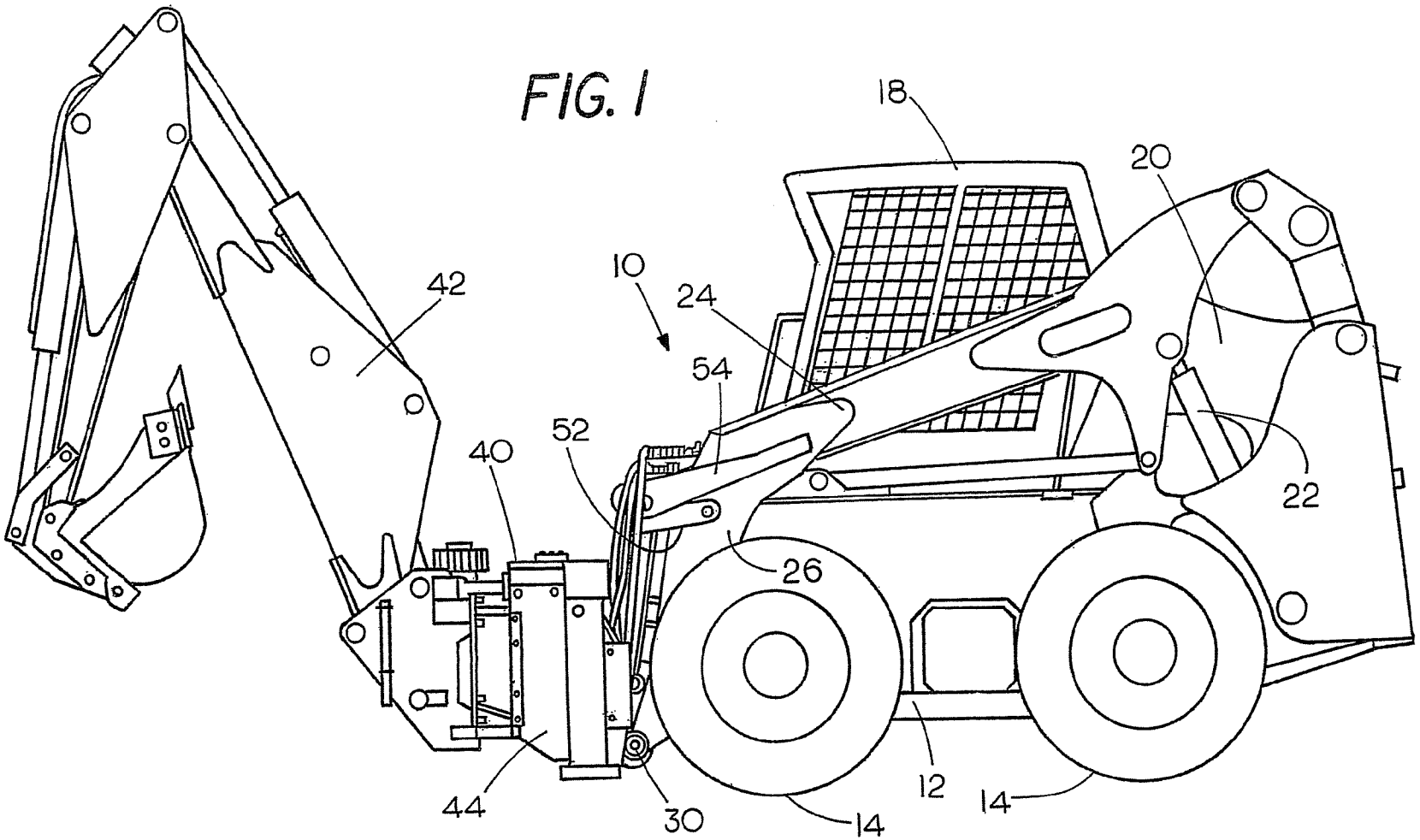
FIG. 1 is a left side elevational view of an implement carrier having an implement as shown and described, a backhoe, mounted thereon and held in place on lift arms with a locking assembly made according to the present disclosure.
Figure 2:
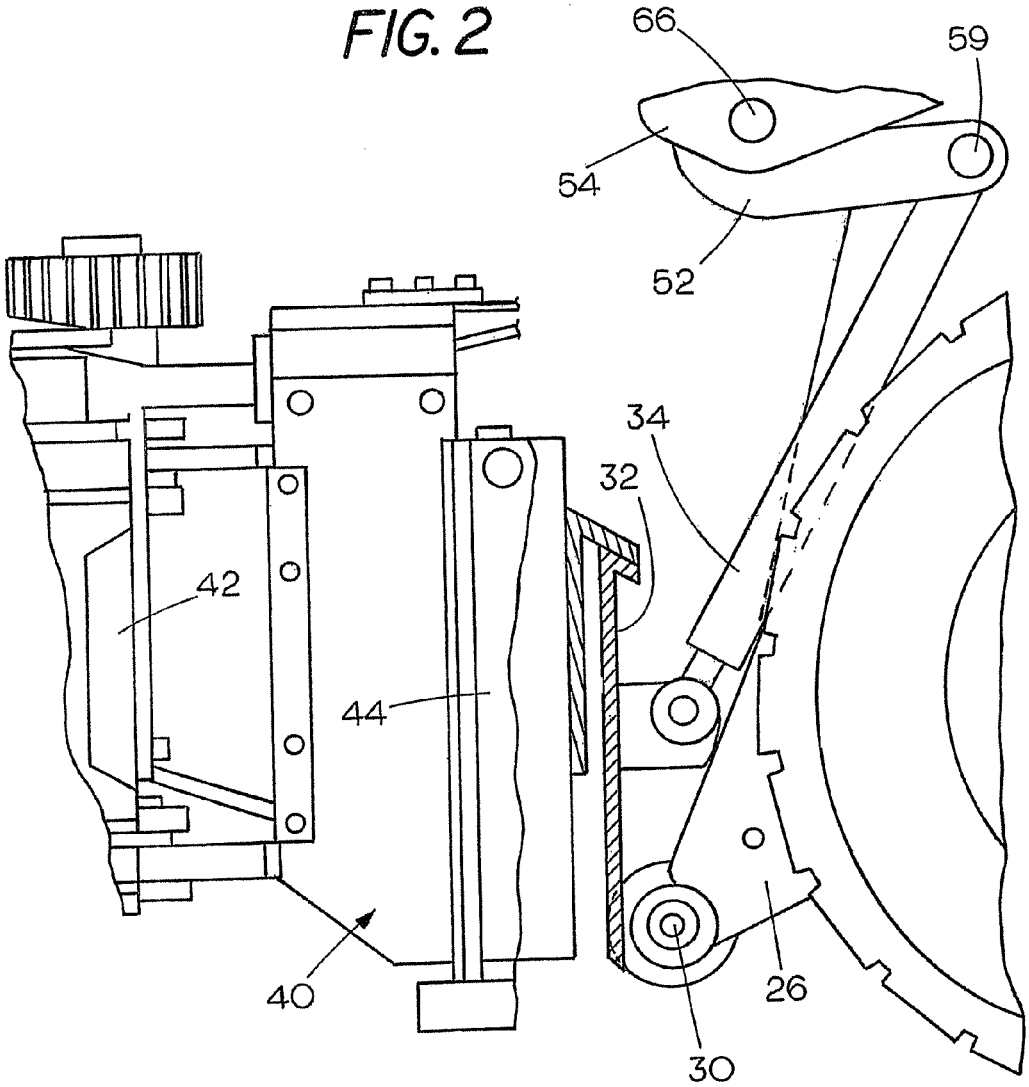
FIG. 2 is a fragmentary sectional view schematically illustrating a support for a mounting frame and a backhoe on a tilting attachment plate of a loader.
Figure 3:
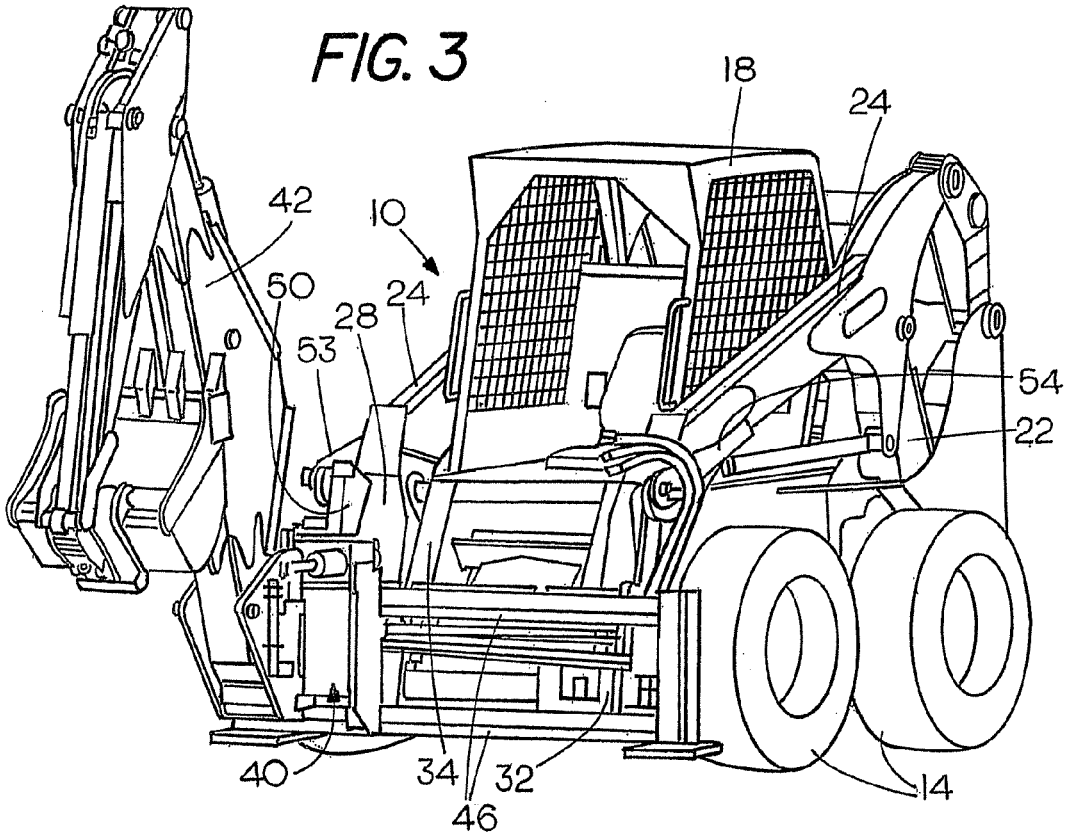
FIG. 3 is a front perspective view of the loader or implement carrier of FIG. 1 having a backhoe mounted thereon and utilizing a locking arrangement made according to the present disclosure.

A carrier vehicle, as shown a compact loader 10, that can be a skid steer loader, a four wheel drive loader, or a track loader, for example, has a frame 12, and wheels 14 for moving the carrier vehicle (called a loader herein) along the ground. The loader 10 has an operator's cab 18, and an engine compartment 20. Hydraulic lift cylinders 22 are used for raising and lowering a pair of lift arms 24 with respect to the main frame 12 in a known manner. The front end portions 26 of the lift arms have a front surface 28, and at the lower ends of the front portions 26 there are pivots 30 that pivotally mount an attachment plate 32, of conventional design, that is tilted about the pivots 30 with tilt cylinders 34. Tilt cylinders 34 are hydraulic cylinders that can be controlled by an operator to extend and retract piston rods to tilt the attachment plate 32.

The hydraulic tilt cylinders 34 are mounted to the respective lift arms (one on each side) with pins 36 that are mounted in sleeves or bushings 38 (see FIG. 8) that are welded in place in the respective forward portion 26 of the lift arms 24. The attachment plate 32 in this form is used for mounting an implement mounting frame 40 in a conventional manner. The mounting frame 40 supports a backhoe 42 (or other implement) for operation by an operator in cab 18, using known controls. The mounting frame 40 will be called a backhoe mounting frame and the implement will be called a backhoe. The backhoe mounting frame as shown, has side plates 44, and cross rails 46 on which the backhoe 42 can be moved laterally relative to the longitudinal axis to the loader 10.

Mounting frame 40 includes upwardly extending portions at the sides of the mounting frame, as shown, upright arms 50 that are fixed to and positioned near the side edges of the mounting frame. The upwardly extending portions or upright arms 50 form part of the backhoe mounting frame. The upright arms 50 are in substantial alignment with the forward portions 26 of the lift arms of the vehicle. The upwardly extending portions or upright arms 50 on the mounting frame may have pads 51 that rest on the front surface 28 of the front portions 26 of the lift arms when the mounting frame is locked in place. The upright arms 50 are used for mounting a locking assembly 53 for securely latching and holding the mounting frame 40 against the front surfaces 28 of the front portions 26. The locking assembly 53 includes a locking link 52, and a locking lever or handle 54.

Figure 5:
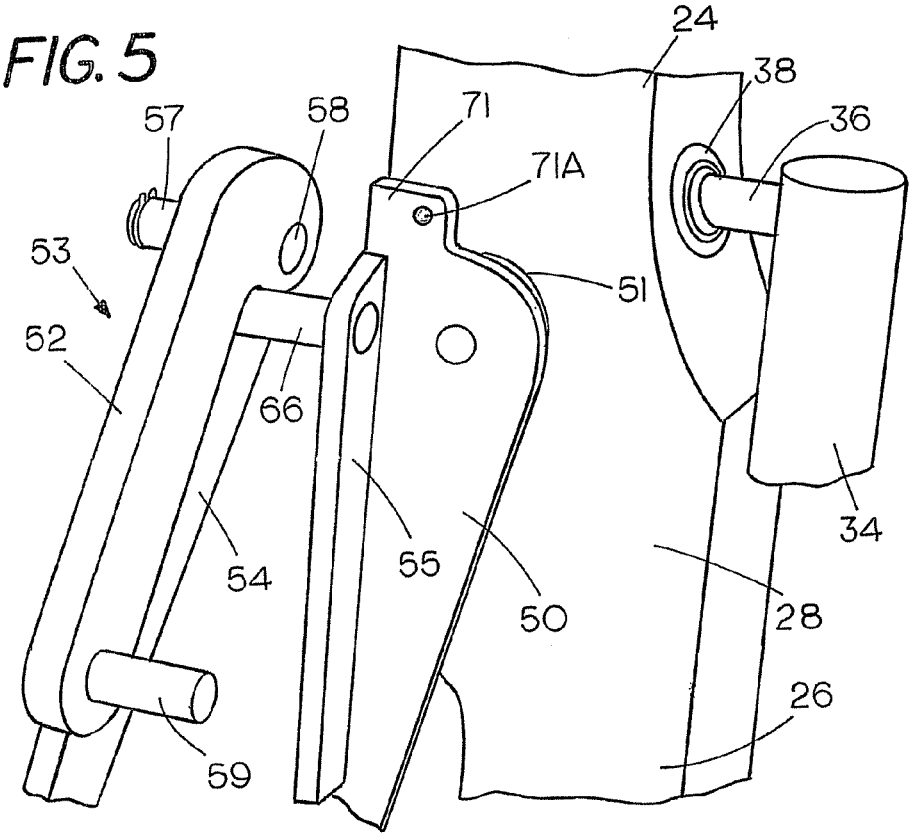
FIG. 5 is a schematic front perspective view of the locking assembly shown in FIG. 4.
Figure 6:
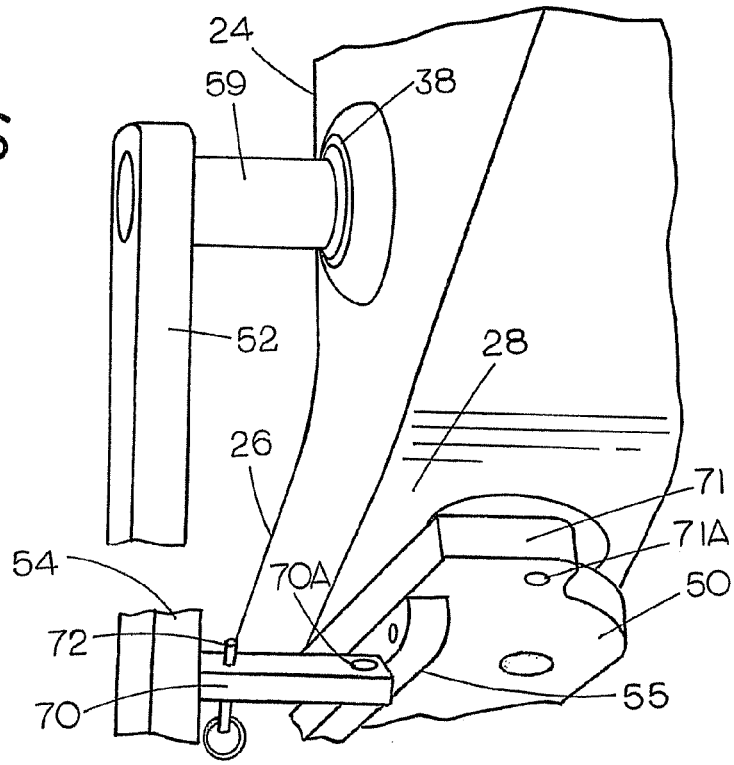
FIG. 6 is a fragmentary top front perspective view of a fixed pivot pin on a locking link aligned with and about to be placed into an existing tilt cylinder pin sleeve on a right side lift arm.
Figure 7:
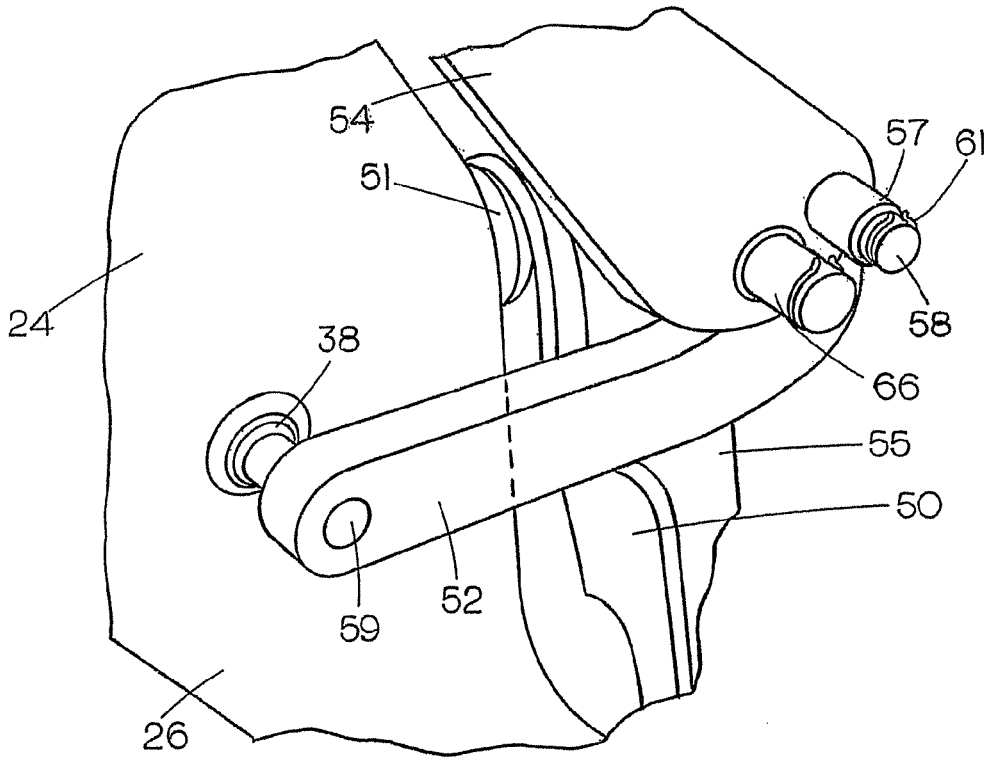
FIG. 7 is a rear perspective view showing the locking link of FIG. 6 in place in a tilt cylinder pin sleeve and the locking handle partially released.
Figure 8:
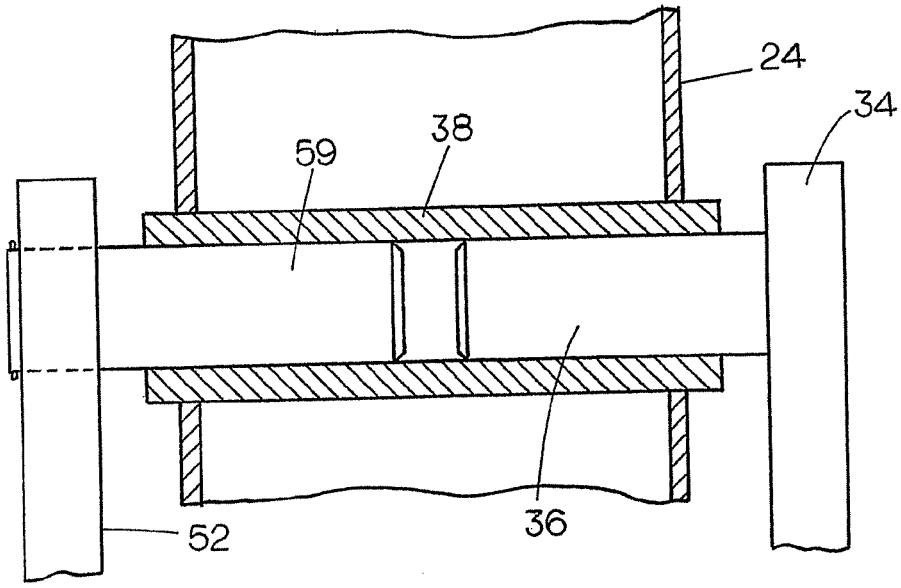
FIG. 8 is a sectional view of a tilt cylinder mounting sleeve on a lift arm with a carrier vehicle, showing a pin for mounting a tilt cylinder and a locking link pin in position in the sleeve.

Referring specifically to FIGS. 4-10, each locking handle is pivotally mounted on an elongated pivot pin 66 fixed to a forwardly projecting flange or gusset 55 forming a part of respective upright arm 50. The elongated pivot pin 66 thus extends laterally out from a side surface of upright arm 50. This description will relate to one locking assembly, but there are two such locking assemblies, one for each of the loader arms for securing the mounting frame. The locking link 52 has a first pivot pin 58 that is rotatably mounted on a sleeve or hub 57 on the locking handle 50 and is held in place on the locking handle with a snap ring 61. Pin 58 is spaced from the pivot pin 66. The locking link 52 also has a second pivot pin 59 at a free end that is fixed to the locking link and is of size and length to fit within the outer end of sleeve or bushing 38 for the tilt cylinder mounting pin, as shown in FIGS. 7 and 8. Pin 36 for the tilt cylinder does not extend for the full length of the sleeve 38, and the pin 59 inserts far enough into the sleeve 38 to adequately support the pin 59 and carry the locking loads. The end of the locking link 52 that is pivoted to the locking handle 54 forms a hook end or offset portion 60 that carries the first pin 58 to provide a latching hook and to properly position pin 58 for the over center action desired.

Figure 4:
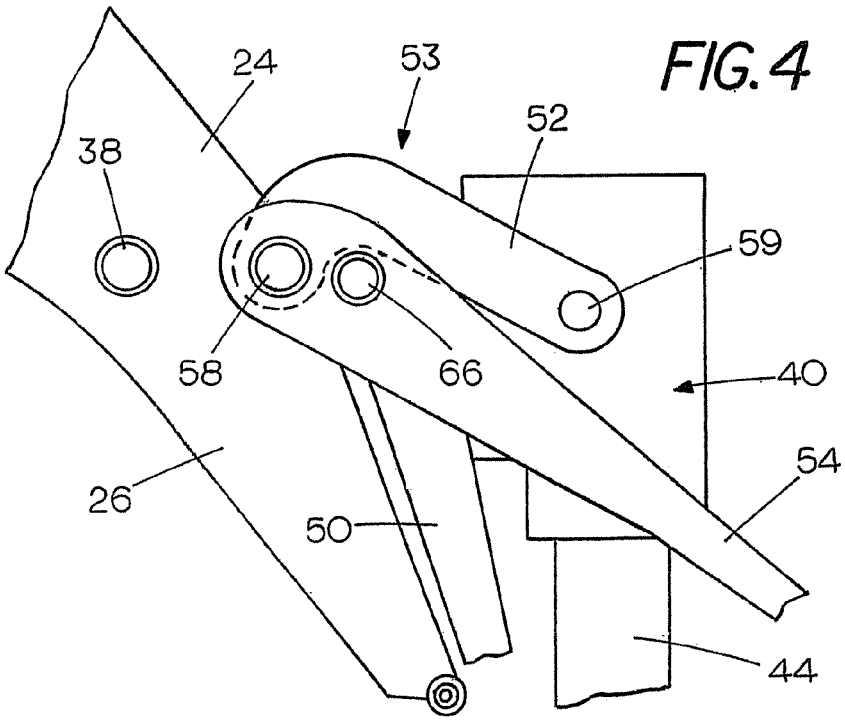
FIG. 4 is a fragmentary, enlarged side view illustrating a locking assembly on a right side of the loader (opposite from FIG. 1) in an unlocked position.

FIG. 4 illustrates the locking assembly in a fully unlocked position. The locking handle is pivoted forwardly, and the locking link 52 is also pivoted forwardly about pin 58.

The elongated pivot pin 66 that mounts the locking handle 54 and the locking link 52 to the upright arm 50 is of length so the locking handle and the attached locking link can move out laterally sufficiently so that end of the pin 59 will clear the side surface of the lift arm, as shown in FIGS. 5 and 6 and then the locking link 52 and locking handle 54 are both pivoted rearwardly to position pin 59 near bushing 38 as shown in FIG. 6. In FIG. 6, the pin 59 is aligned with the end of the sleeve or bushing 38, and the locking handle 54 has been broken away to show the locking link 52.

The locking handle 54 and the locking link 52 are then slid along the elongated pin 66 back toward the upright arm 50 on the mounting frame, and thus toward the outer side of lift arm front portion 26 so that the pin 59 can be slid into the sleeve or bushing 38 to the position shown in FIG. 8.

The locking handle is also pivoted in counterclockwise direction as shown in FIG. 7 when the pin 59 is inserted into bushing 58. The upright arms 50 may be positioned slightly from front surface 28 of the lift arms.

FIG. 7 illustrates the locking link 52 in a position such that the second pivot pin 59 is inserted into the bore of the bushing or the sleeve 38, and it can be seen that the locking handle 54 is in a partially locked position after having been pivoted rearwardly to align pin 59 with the bore in sleeve 38. The outer end of elongated pin 66 extends out from the locking handle, since the locking handle has been moved toward the upright arm 50 to position the pin 59 in the sleeve bushing 38. The locking link is positioned between the locking handle and the side of the arm 50.

Once the pin 59 and the locking link 52 have been positioned with the pin 59 fully in the sleeve or bushing 38, the locking handle can be moved to its fully locked position shown in FIG. 9. The hook end 60 fits partially around or hooks on the base end of the pivot pin 66 adjacent the side of the upright arm 50 and to the inside of the locking handle 54.

It can be seen that the line between the pivot axes for the pin 59 and the pin 58 forming first and second pivot pins on the locking link, goes over center with respect to the axis of the pin 66 that mounts the locking assembly 53 to the upright arms.

In order to ensure that the locking lever 54 will not disengage or unlock, (the overcenter action is normally enough) the locking handle is pinned to the upright arm 50 as shown in FIG. 10. The locking handle 54 has a locking tab 70 that extends laterally out and mates with the forward surface of the upright arm 50. The upright arm 50 has a tab end 71 that has an opening 71A that aligns with an opening 70A in the locking tab 70. A pin 72, that is held onto the tab 70 with a chain 74, can be inserted into both of the aligning openings, 70A on the tab 70 and 71A on the upright tab end 71 of the locking arm 51. The pin 72 has a spring loaded retaining ring 75 will fit over the upper end of the tab end 71 on the upright arm 50 and thus be held in place. The openings in locking tab 70 and upright tab 71 with a retaining pin through the aligning openings can be used for securing the locking handle in a latched position even if the locking linkage does not go over center when the locking handle reaches its locked or latched position. The securing of the tab 70 and tab portion 71 together also prevents the locking assembly 51 from sliding outwardly on the pin 66, so pin 59 remains in the sleeve 38. Thus, securing the locking assembly to retain the mounting frame on the lift arms can be done with a securing member to hold the locking handle in locked or latched position.

As stated the hook end 60 of the locking link positions the axis of pin 58 at a position so the pivot axes of pins 58 and 59 are oriented properly so that the line between these axes will go over center with respect to the axis of pin 66 when the locking handle is moved to its locked position. Because the locking link 52 is next to the side surface of arm 50, which mounts the pin 66, the hook end can engage and latch on the base of the pin 66, to provide the latching or securing for the upright arm 50. In other words, the hook end 60 of the locking link secures the upright arm 50 in position. The base end of pin 66 also forms a stop for the locking link and locking handle, to prevent the locking link from continuing to move past a desired latched position.

A locking assembly 53 is carried on each of the upright arms 50 and when the mounting frame 40 is placed onto the tilting attachment plate, and tilted rearwardly so that the arms 50 are adjacent the forward surfaces 28 of the forward portions 26 of the lift arms, the locking link can be placed into position in the respective sleeve 38 quickly and easily, and then by merely moving each locking handle to its locked position, the hook ends of the locking links will engage the pins 66 and secure the upright arms and the mounting frame for the backhoe or other attachment in position. No special modifications of the lift arms are needed.

If desired, the pivot for the locking link 52 to the lift arm can be made in other ways, such as using a separate pin or bore on the lift arm.

Although the present invention has been described with reference to preferred embodiments, workers skilled in the art will recognize that changes may be made in form and detail without departing from the spirit and scope of the invention.

What is claimed is:

1. A mounting frame for mounting an implement to a lift arm on a carrier vehicle, comprising:

an upper portion including a lock projection;

a locking handle pivotally mounted on said upper portion and moveable between a locked position and a released position;

a locking link having a first end having a hook portion with a first pivot pin extending from the hook portion and wherein the locking handle is pivotally mounted to the first pivot pin, and a second end having a second pivot pin extending therefrom, the second pin being pivotally mountable to the lift arm; and wherein when the locking handle is moved from a released position to a locked position, the hook portion engages the lock projection between axes of the first and second pivot pins of the locking link and the locking handle moves about the first pivot to hold the hook portion in engagement with the lock projection.

2. The mounting frame of claim 1, wherein the second pivot pin of the locking link is configured to be inserted into a bushing on the lift arm with the locking handle in the released position.

3. The mounting frame of claim 1, wherein the locking link is positioned between the locking handle and the upper portion.

4. The mounting frame of claim 1 and further comprising:

a stop on the upper portion of the mounting frame and a tab on the locking handle positioned to engage the stop when the locking handle is in a locked position.

5. A toggle linkage to secure a mounting frame to a lift arm of a carrier vehicle, said toggle linkage comprising:

a first locking member pivotally mounted on the mounting frame;

a second locking member having a first end engageable with a lift arm, said first locking member being pivotally connected to a second end of the second locking member;

wherein the first locking member is moved about the pivotal mounting in a first direction from an unlocked position to a retained position to cause the second locking member to exert a force through the first locking member to pull the mounting frame toward the lift arm.

6. The toggle linkage of claim 5, and a securing member acting to secure the first locking member in the retained position.

7. The toggle linkage of claim 6, wherein the securing member comprises a tab on the first locking member that is configured to be secured to the mounting frame.

8. The toggle linkage of claim 5, wherein the second end of the second locking member is pivotally connected to the first locking member about a pivot axis spaced from a pivot axis of the pivotal mounting, the first end of the second locking member having a pivot engageable with the lift arm, and wherein as the first locking member is pivoted in the first direction a line between the pivots at the first and second ends of the second locking member goes over center with respect to the pivot axis of the pivotal mounting of the first locking member, and wherein the toggle linkage further comprises a stop configured to limit the amount of movement of the locking members after the line has gone over center.

9. The toggle linkage of claim 8, wherein said stop comprises a pin forming the pivotal mounting.

10. The toggle linkage of claim 9, wherein said second locking member has a hook portion formed adjacent the pivot between the first and second locking members, said hook portion configured to engage the pin forming the stop when the first locking member is in the retained position.

11. A method of attaching an implement to a lift arm of a carrier vehicle, comprising:

positioning the implement so that a portion of the mounting frame having a lateral projection adjacent to the lift arm so that the lateral projection extends in a lateral direction with respect to the lift arm;

pivotally coupling a locking handle to the locking link;

engaging the lift arm with a locking link; and rotating a locking handle to cause the locking link to engage and apply a holding force against the lateral projection.

12. The method of claim 11 and further comprising pivotally coupling the locking handle to the lateral projection.

13. The method of claim 12, wherein pivotally coupling the locking handle to the lateral projection includes allowing the locking handle to slide over the lateral projection after the locking handle is coupled to the lateral projection.

14. The method of claim 11, wherein engaging the lift arm with the locking link includes inserting a first pin extending from the locking link into an aperture on the lift arm.

15. The method of claim 14, wherein pivotally coupling the locking handle with the locking link includes mounting the locking handle onto a second pin extending from the locking link.

16. The method of claim 15, wherein engaging locking handle with the locking link includes inserting the second pin extending from a hook portion the locking link into an aperture on the locking handle.

17. The method of claim 16, wherein causing the locking link to engage and apply a holding force against the lateral projection includes causing the hook portion of the locking link to move adjacent the lateral projection.

18. The method of claim 17, wherein rotating the locking handle causes a locking tab extending laterally from the locking handle to be moved adjacent to a portion of the mounting frame.

19. The method of claim 18 and further comprising securing the locking tab to the mounting frame.

20. The method of claim 11 and further comprising attaching the implement to an implement carrier that is pivotally coupled to the lift arm.

* * * * *